United States Patent [19]

Kayserling

[11] 4,170,945

[45] Oct. 16, 1979

[54] MOTORIZED RAILWAY VEHICLES

[75] Inventor: Ulrich Kayserling, Nuremberg, Fed. Rep. of Germany

[73] Assignee: Maschinenfabrik Augsburg-Nurnberg Aktiengesellschaft, Nüremberg, Fed. Rep. of Germany

[21] Appl. No.: 846,815

[22] Filed: Oct. 31, 1977

[30] Foreign Application Priority Data

Oct. 30, 1976 [DE] Fed. Rep. of Germany ..... 2650035

[51] Int. Cl.[2] ..... B61C 3/00; B61C 9/44; B61C 9/48; B61C 17/00

[52] U.S. Cl. ..... 105/133; 105/131; 105/132; 105/136; 105/199 R

[58] Field of Search ..... 105/131, 133, 135, 136, 105/137, 138, 139, 132, 199 R

[56] References Cited

U.S. PATENT DOCUMENTS

| | | | |
|---|---|---|---|
| 2,135,394 | 11/1938 | Geissen | 105/133 X |
| 2,955,547 | 10/1960 | Ebenbach | 105/139 |
| 3,135,224 | 6/1964 | McLean | 105/136 |
| 3,877,388 | 4/1975 | Hall et al. | 105/139 |

FOREIGN PATENT DOCUMENTS

| | | | |
|---|---|---|---|
| 50109 | 4/1941 | Netherlands | 105/131 |
| 575307 | 5/1976 | Switzerland | 105/131 |

OTHER PUBLICATIONS

Siemens Journal No. 11/1966; pp. 800 to 809.

*Primary Examiner*—Francis S. Husar
*Assistant Examiner*—Howard Beltran
*Attorney, Agent, or Firm*—Becker & Becker, Inc.

[57] ABSTRACT

A bogie arrangement for self-propelled high-speed rail vehicles with at least two driving bogies supporting the vehicle body. Each of the driving bogies is powered by at least one electric motor and supports the vehicle body by a spring system while having a common pivot point with the vehicle body. The rotor of the fully spring-cushioned and transversely extending motor is operatively connected to the driving wheel set through the intervention of a transmission and a cardan quill shaft having elastic articulated bearings. The motor is held in the space between the wheel set axle and the vertical central transverse plane of the bogie transversely swingably on the understructure of the vehicle body. The longitudinally acting forces of the motor are transmitted by at least one link of considerable length from the housing of the motor to the adjacent frame section of the vehicle.

18 Claims, 7 Drawing Figures

MOTORIZED RAILWAY VEHICLES

The invention relates to a bogie arrangement for self-propelled high-speed rail vehicles with at least two electric motor driven bogies each of which resiliently supports the car body and has a pivot point in common therewith.

A bogie arrangement for high-speed rail vehicles has become known which has a bogie on whose frame the body of the vehicle is supported by means of laterally arranged spring means and where acceleration and deceleration forces are transmitted by a central pivot which is relieved of vertical forces and projects into a crosshead which crosshead is also guided by at least one pair of links relative to the bogie frame. This running gear has been designed only as a carrying bogie and not yet for the speeds to be applied nowadays.

There has also become known a bogie guide system for a gas-spring cushioned high-speed bogie in which the frame of the bogie is articulately connected by an articulated traction rod to the body of the vehicle, said traction rod being arranged in the vertical longitudinal central plane of the vehicle. The lateral play possible between the two vehicle elements is adapted to be limited by an elastic limitation of side swing. With this bogie the vehicle box load is likewise laterally transmitted to the bogie frame by gas spring means and without the intermediary of a swing bolster.

Another starting point for the bogie arrangement according to the present invention is the cardan quill shaft drive for traction motors according to which the rotor axis of the motor is parallel to the axis of the wheel set axle. In this instance the housing of the motor is elastically suspended at at least three points in the frame of the bogie. Torque transmission between the motor rotor and the driving wheel set in this case is effected by means of a pinion, gear, a first articulately yieldable coupling, a cardan quill shaft surrounding the driving wheel set axle and a second articulately yieldable coupling. The different degrees of elastic flexibility of these couplings in the y direction and respectively relative to the common axis of the wheel set and the quill shaft takes care of the relative movements of the components resulting from the motor suspension. The gear is rotatably supported on a hollow trunnion connected to the motor through which the cardan quill shaft extends with a clearance. The wheel set in this case is capable of lateral displacement and scissor movements relative to the motor which is supported by the primary spring suspension of the bogie, whereas the motor follows the vertical spring deflection afforded by the interposed primary spring suspension in the vertical direction.

In the known bogie arrangements, the non-spring supported masses acting in the vertical direction have been substantially reduced. It has been found, however, when increasing the speeds into ranges which only recently have been adopted for regular operation, that the influence of the large masses, e.g. of the traction motors including their reduction gearings, have still a most adverse effect on the running of the bogie in the horizontal transverse plane as well as on the wear of the sides of wheel flanges and track rails.

It is, therefore, an object of the present invention to create or, respectively, further develop a bogie arrangement suitable in particular for high-speed vehicles in order to meet the requirements of bogies capable of high speeds and to overcome the disadvantages of known designs. Thus the invention is intended, inter alia, to reduce the influence of the large masses of the propulsion equipment with special regard to the influence of the displacement in the horizontal transverse direction and the turning motions of the bogies. Equally the invention is intended to leave a large amount of space between the wheel set axles and the bogie side members for the installation of the fully spring-cushioned motors including accessories.

These and other objects and advantages of the invention will appear more clearly from the following specification in connection with the accompanying drawing in which.

The objective of the present invention has been completely realized by the present invention which is characterized primarily in that the motor is held by at least three vertical swing links in the space between the wheel set axle and the vertical central transverse plane y of the bogie to be capable of transverse oscillation on the underframe of the body and that the longitudinal forces of the motor are transmittable by at least one link of considerable longitudinal extension from the motor housing to the adjacent frame member of the vehicle.

This results in the following advantages. The non-spring supported masses of the propulsion equipment are reduced to a minimum. The influence of the inertia moment of the propulsion equipment of the above-mentioned bogie motions is extremely reduced. This has a favorable effect due to the reduction in wheel flange wear and wear of the side faces of the rails. Turning motions about the "z" axis are opposed by a low turning moment. Pitching motions of the frame about the "y" axis are initiated to a lesser extent. Due to the elimination of suspension studs and the like in the bogie frame, no space is required therefor. The sine course is stabilized by three features, especially in the higher speed range.

The disadvantage of higher commutator stresses can be overcome by providing yieldability in the circumferential direction in one of the flexible joints of the drive.

The maximum possible horizontal transverse displacement between the motor and the bogie frame is expediently limited in order to avoid the need to design the three-dimensional joints in the drive for excessive displacements. Transverse spring elements (resilient stops) and a free side swing are provided because of the segregation of transverse oscillation of the sine course and the bogie frame oscillation.

As a result of the design of the joints of swing links and torque reaction supports as rubber-metal bonded composite joints, any wear at these parts is eliminated.

The control of the turning motion of the bogie about the "z" axis through servosystems controllable by control apparatus further contributes towards an improvement in the running of the bogie and in the reduction of wear on wheel flanges and rail sides. In addition to the equipment referred to, features may be incorporated which stabilize the straight-ahead running.

The invention provides the designer with several possibilities of a space-saving design of the pivot point between the bogie and the body. The preferred arrangement is a design without a pivot pin using a central longitudinal link in which the body is suitably supported by gas spring means on the bogie frame.

Figure 2:
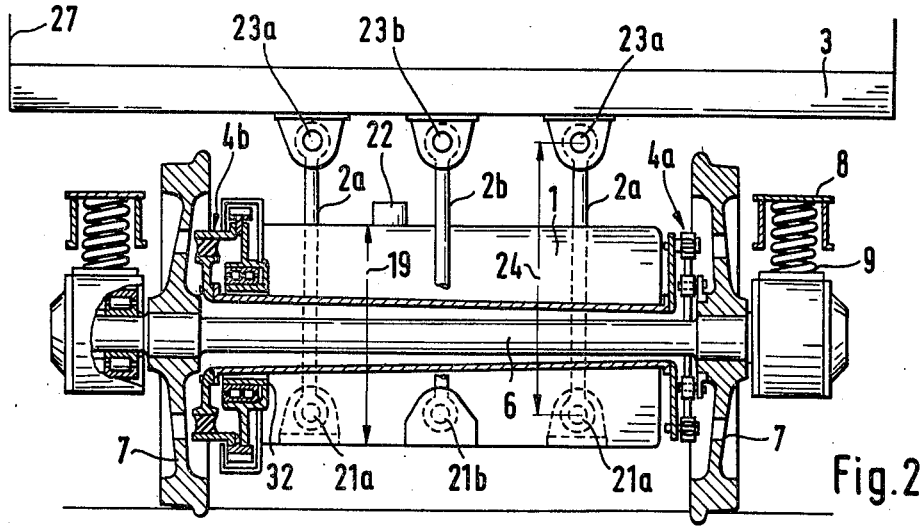
FIG. 2 is a cross section taken along the line II—II of FIG. 1 and showing in particular the cardan quill shaft drive and the motor suspension of the underframe, shown diagrammatically only.
Figure 1:
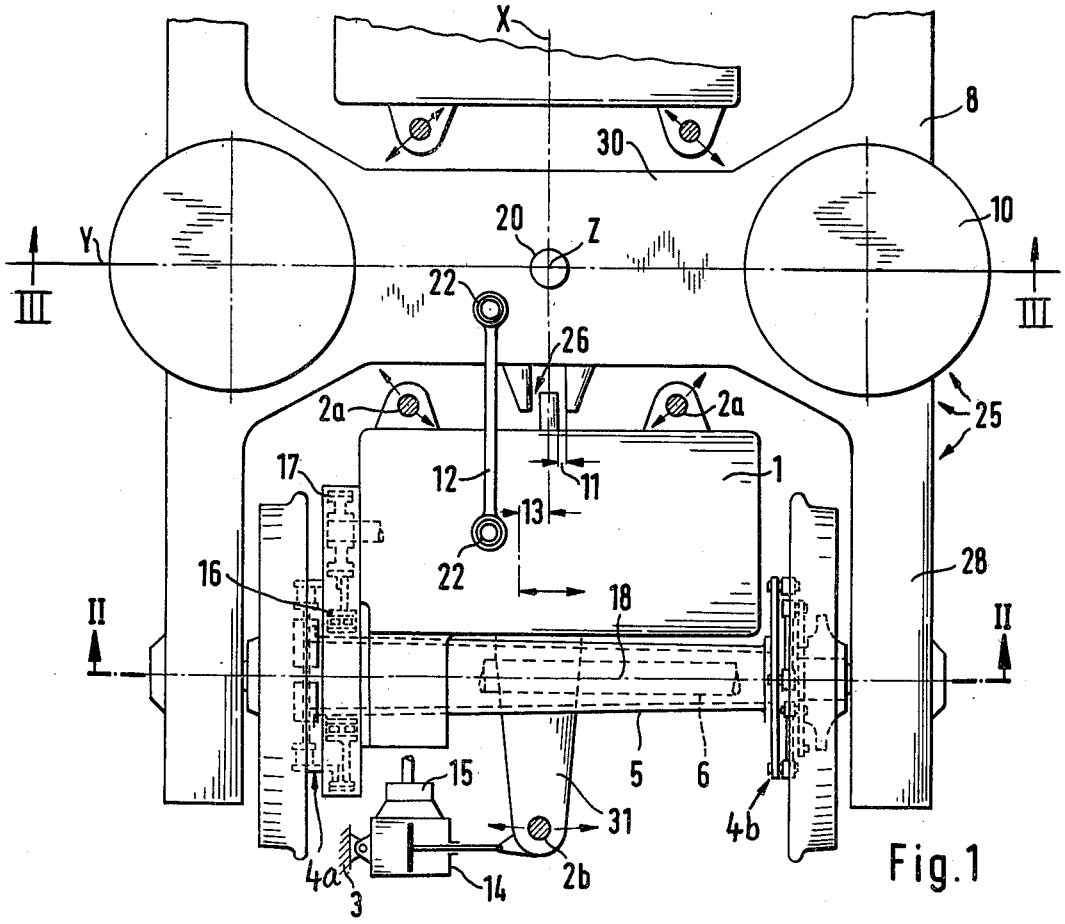
FIG. 1 is a plan view of the bogie arrangement according to the invention with the only schematically shown pivot point between the bogie and the body (not shown).
Figure 3:
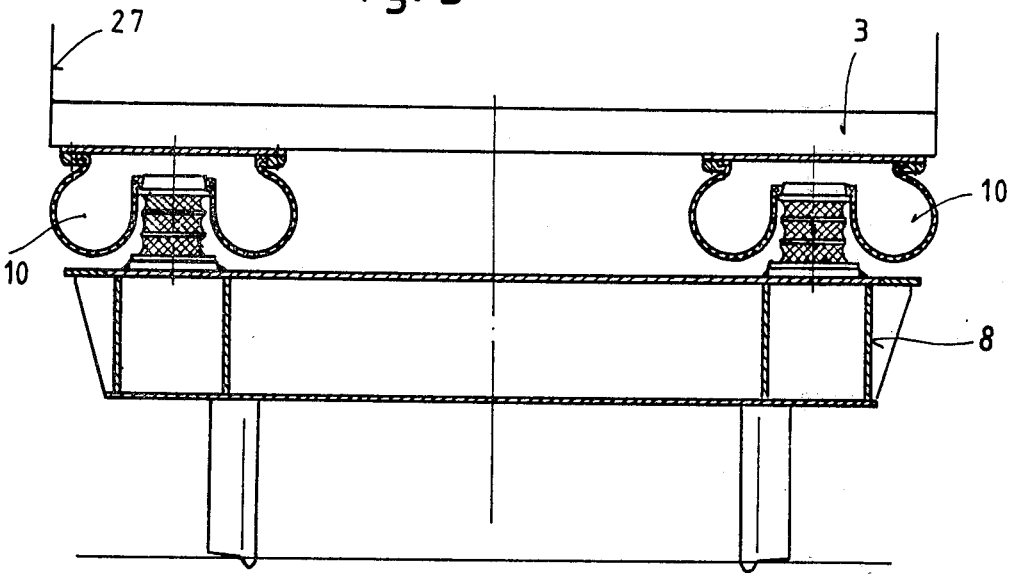
FIG. 3 is a cross-sectional elevational view taken along line III—III in FIG. 1.
Figure 4:
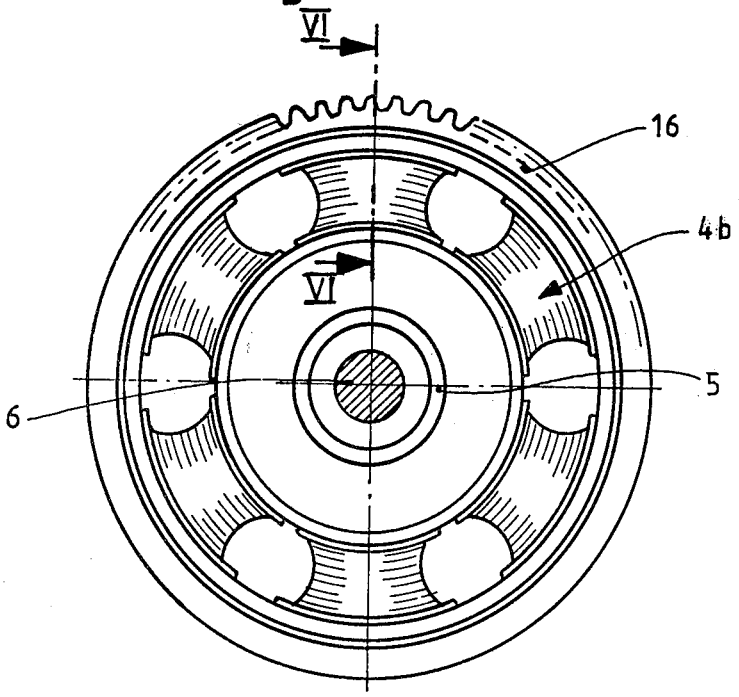
FIG. 4 is a plan or side elevational view of a gear having a radially non-flexible articulated bearing in accordance with the present invention.
Figure 5:
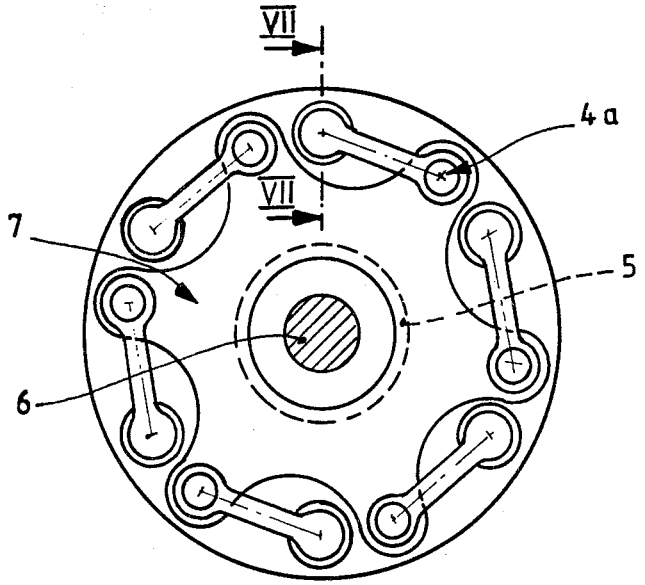
FIG. 5 is a plan or side elevational view of a wheel set having a radially non-flexible articulated bearing means.
Figure 6:
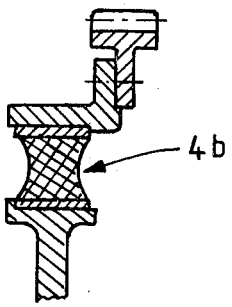
FIG. 6 is a fragmentary non-sectional view taken along line III—III in FIG. 4.
Figure 7:
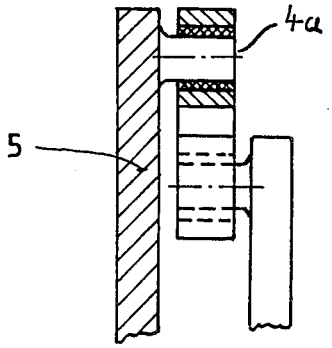
FIG. 7 is a fragmentary non-sectional view taken along line III—III in FIG. 5.

Referring now to the drawing in detail, FIGS. 1 and 2 show the essential parts of the bogie arrangement according to the invention with the pivot point 20 only shown schematically and the body 27, supported through spring means 10 on the bogie 25, likewise shown schematically only. Wheel sets consisting of axle 6 and wheels 7 supported by a primary spring suspension 9 are rotatably supported in frame 8 of this bogie 25.

The electric motor 1 is held on swing links 2 so as to be capable of oscillation in the lateral direction "Y" and about the vertical axis "z" in the space which is confined by the wheel set axle 6, wheels 7 and the side members 28 and transom 30. The effective lengths 24 of the swing links 2 are obtained from the oscillation analysis or calculation. The natural frequency of the swing link or pendulum-like suspension distinctly differs from the frequency of sine course and the secondary lateral spring action. For purposes of connecting the motor housing to the lower end of each pendulum or swing link **2*a*, 2*b*, and low ends of said swing links 2*a*, 2*b* are provided with three dimensional joints 21** preferably bonded rubber-metal composite joints which are adapted to be journaled in and pivotally connected to lugs or the like which are connected to or form a single piece with the motor housing. For kinetic reasons or reason of space said lugs may also be designed as cantilever arms.

The motor torque is transmitted from the rotor of the motor 1 via the pinion 17 to the gear 16 which is rotatably supported on a hollow trunion 32 mounted on the motor housing. In the zero position of the bogie, the hollow trunion is coaxial with the wheel set axle 6 (center 18). Transmission of the torque from the gear 16 is effected by a first flexible articulated bearing **4*b* to the cardan quill shaft 5 which extends through the hollow trunnion 32 and surrounds that part of the wheel set axle 6 which lies between the wheels 7. From the bell-shaped end of the cardan quill shaft 5, the torque is transmitted through another flexible resilient articulated bearing 4*a* to the wheel 7 or respectively the wheel set axle 6. On deceleration, the torque transmission obviously occurs in the inverse direction. Of the two articulated bearings, bearing 4*b* in the gear 16 is preferably yieldable mainly in the acting direction of the torque and bearing 4*a* primarily in the axial direction. The radially non-flexible articulated bearing 4*a* is well balanced and centers the quill shaft 5 accurately on the wheel set axle. The quill shaft 5 is dynamically balanced with the wheel set 6, 7**.

The transmission of the inertia forces of the motor is effected by means of a link 12 which is connected at both ends by means of three-dimensional bonded-rubber-metal composite joints. That end of the links 12 which is remote from the motor may be connected to the frame 8 or to the underframe 3.

According to the invention, conventional configurations are proposed for the physical design of the pivot point 20. If, for instance, a known physical pivot pin is to be provided, the pivot will project into a wear resistant joint in a yoke which, in turn, is held by means of two longitudinal links supported in wear resistant bushings relative to the transom 30 of the bogie. The possible side swing of the bolster can be limited by means of elastic stops.

As secondary suspension (spring means 10) gas springs are provided at both sides. Each gas spring in this embodiment is arranged to be capable of being subjected to stresses both in a vertical and in a radial acting direction.

The possible maximum lateral displacement 11 between the bogie 25 and the body 27 can be limited in the usual manner by means of a side swing control device 26 or elastic transverse buffers. The servo-mechanism 14 which in this embodiment is shown in the form of a double acting piston/cylinder unit acting in a transverse direction on the arm 31 at a certain distance from the pivot joint 20 is optional to further decrease wear on the wheel flanges and rail sides when negotiating curves. In place of this unit, an electric motor/magnetic unit could be used. Instead of the device 14 also a shock absorber or a buffer may be employed.

Actuation of the servo-mechanism 14 by means of the power medium employed (compressed air, pressure oil or electric power) is controlled by a control device 15. If the rail vehicle is equipped with a control system for tilting the car body as a function of the curve radius, this device may be combined with the control unit 15.

It is, of couse, to be understood that the present invention is, by no means, limited to the particular showing in the drawing but also comprises any modifications within the scope of the appended claims. Thus, it is within the scope of the present invention to combine the servo-mechanism 14 with any suitable known system of rotation control 38.

What I claim is:

1. In combination with the body of a self-propelled high speed rail vehicle having a frame member, a bogie arrangement which includes: at least one driving bogie supporting said body including an underframe, each bogie comprising a transverse beam and two longitudinal substantially parallel beams laterally spaced from each other and forming with said transverse beam an H configuration, at least one electric motor having a housing and a rotor drivingly connected to said at least one driving bogie, each bogie having at least one motor-driven driving-wheel set drivingly connected to one said motor, each driving-wheel set including an axle and wheels supported thereby, each bogie supporting the body through a secondary suspension and having a common pivot point with said body, the rotor of the motor being connected via gearing and a cardan quill shaft drive having flexible articulated bearings to the driving wheel set, a plurality of swing links pivotally connected to said motor and pivotally supporting the respective motor for oscillation in a direction transverse to the respective bogie, and each bogie also comprising at least one link means pivotally connected to said adjacent motor for transmitting forces acting in the longitudinal direction of said bogie and absorbing said forces, said motor being held by at least three vertical swing links in the space between the wheel set axle and the transverse beam to be capable of transverse oscillation on the underframe of the body and the longitudinal forces of said motor being transmittable by at least one link of considerable longitudinal extent from the housing of said motor to the adjacent frame member of the vehicle.

2. An arrangement in combination according to claim 1, in which said motor is located in the space defined in the pertaining bogie by the driving wheel set axle and its wheels and the transverse beam and those sections of said longitudinal beams extending laterally of the end faces of the pertaining motor.

3. An arrangement in combination according to claim 1, in which said link means extends in a horizontal plane and in the longitudinal direction of the respective pertaining bogie and has one end portion pivotally connected to said transverse beam.

4. An arrangement in combination according to claim 1, in which said link means extends horizontally and rests on said vehicle body.

5. An arrangement in combination according to claim 1 which includes means for limiting the transverse movement of said motor in said bogie.

6. An arrangement in combination according to claim 5, in which said means for limiting the transverse movement of said motor includes elastic abutment means.

7. An arrangement in combination according to claim 1, in which each of said swing links has that end thereof which is connected to the motor supported thereby provided with a rubber-metal compound joint for permitting three dimensional movements of the pertaining motor.

8. An arrangement in combination according to claim 1, which includes control means operatively connected to said motor for controlling the transverse movement of the pertaining motor.

9. An arrangement in combination according to claim 5, in which the means for limiting the transverse movement of said motor includes means respectively arranged on both sides of said vehicle body and respectively operatively connected to said bogie.

10. An arrangement in combination according to claim 8, in which said control means respectively include a pneumatic cylinder-piston unit operable in two directions opposite to each other.

11. An arrangement in combination according to claim 8, in which said control means respectively include a hydraulic cylinder-piston unit operable in two directions opposite to each other.

12. An arrangement in combination according to claim 8, in which said control means respectively include an electromagnetic unit operable in two directions opposite to each other.

13. An arrangement in combination according to claim 8, which includes means responsive to the transverse bogie displacement when passing through a curve for actuating said control means.

14. An arrangement in combination according to claim 8, which includes means responsive to the centrifugal force acting upon said bogie when the latter pass through a curve for actuating said control means.

15. An arrangement in combination according to claim 1, which includes spring means interposed between said vehicle body and said bogie, and in which the pivot point is designed as pivot relieved from vertical forces.

16. An arrangement in combination according to claim 15 in which said spring means include gas spring bellows, and which includes longitudinal link means for transmitting accelerating and retarding forces between said bogie and said vehicle body.

17. An arrangement in combination according to claim 1, in which each bogie includes: a cardan quill shaft, a first elasticly yieldable joint drivingly interconnecting the respective motor and said cardan quill shaft, and a second elasticly yieldable joint drivingly connecting said cardan quill shaft to the shaft of the pertaining driving wheel set, said first and second elasticly yieldable joints comprising elastic material which in said first elasticly yieldable joint is yieldable mainly in the circumferential direction of said last mentioned joint whereas in said second elasticly yieldable joint is yieldable mainly in a horizontal transverse direction but is rigid in radial direction.

18. An arrangement in combination according to claim 17, in which said second elasticly yieldable joint is dynamically balanced and forms a pendulum joint.

* * * * *